United States Patent [19]

Shabtai et al.

[11] Patent Number: 4,728,418

[45] Date of Patent: Mar. 1, 1988

[54] PROCESS FOR THE LOW-TEMPERATURE DEPOLYMERIZATION OF COAL AND ITS CONVERSION TO A HYDROCARBON OIL

[75] Inventors: Joseph S. Shabtai, Salt Lake City, Utah; Ikuo Saito, Sakuramura, Japan

[73] Assignee: University of Utah, Salt Lake City, Utah

[21] Appl. No.: 790,430

[22] Filed: Oct. 23, 1985

[51] Int. Cl.[4] ..... C10G 1/06

[52] U.S. Cl. ..... 208/413; 208/403; 208/405; 208/406; 208/420; 208/422

[58] Field of Search ..... 208/403, 405, 406, 413, 208/420, 422, 412

[56] References Cited

U.S. PATENT DOCUMENTS

| | | | |
|---|---|---|---|
| 2,202,901 | 6/1940 | Dreyfus | 208/403 X |
| 3,502,564 | 3/1970 | Hodgson | 208/423 X |
| 3,532,617 | 10/1970 | Hodgson | 208/423 X |
| 3,549,512 | 12/1970 | Hodgson | 208/422 X |
| 3,677,932 | 7/1972 | Hardesty et al. | 208/406 X |
| 4,176,051 | 11/1979 | Ternan et al. | 208/421 X |
| 4,333,815 | 6/1982 | Vermeulen et al. | 208/406 |
| 4,376,695 | 3/1983 | Belinko et al. | 208/421 X |
| 4,518,478 | 5/1985 | Walker | 208/420 |

FOREIGN PATENT DOCUMENTS

| | | | |
|---|---|---|---|
| 3416224 | 5/1984 | Fed. Rep. of Germany | 208/413 |

*Primary Examiner*—Asok Pal

*Attorney, Agent, or Firm*—Trask, Britt & Rossa

[57] ABSTRACT

A novel process for the low-temperature depolymerization and liquefaction of coal wherein the coal is subjected to sequential processing steps for the cleavage of different types of intercluster lnikages during each processing step. A metal chloride catalyst is intercalated in finely crushed coal and the coal is partially depolymerized under mild hydrotreating conditions during the first processing step. In the second processing step the product from the first step is subjected to base-catalyzed depolymerization with an alcoholic solution of an alkali hydroxide, yielding an almost fully depolymerized coal, which is then hydroprocessed with a sulfided cobalt molybdenum catalyst in a third processing step to obtain a hydrocarbon oil as the final product.

20 Claims, 5 Drawing Figures

PROCESS FOR THE LOW-TEMPERATURE DEPOLYMERIZATION OF COAL AND ITS CONVERSION TO A HYDROCARBON OIL

BACKGROUND

1. Field of the Invention

This invention relates to the production of hydrocarbon oils from coal and, more particularly to a novel process involving the low-temperature depolymerization and liquefaction of coal whereby the depolymerization is achieved through a sequence of processing steps.

2. The Prior Art

Coals vary in rank from peats to anthracites with a spectrum of grades in between such as lignites, subbituminous and bituminous coals. The fossilized remains of plant structures in coal indicate that plants were the source material for the coal. It has been commonly assumed that coals were formed by a variety of biodegradative and geochemical transformations of plant debris that have taken place over an extended period of time. The rank of the coal depends on the length and rate of the coalification process. The progress of the coalification of coal from lignite to anthracite results in a general decrease in hydrogen and oxygen contents of the organic matter. Carbon content, on the other hand, increases from about 70% and below in lignite to over 90% in anthracite. Oxygen functionality also varies with rank.

Because of its complexity, it is nearly impossible to assign a specific molecular structure to coal. There is no uniform repeating monomer unit in coal such as is found in saccharides, proteins, and cellulose. Results and interpretations derived from numerous studies of coal liquids, produced by high temperature liquefaction processes, have led to tentative proposals on the structure of coal. A general concensus has been reached that coal is made up of a variety of condensed naphthenoaromatic ring systems designated as "clusters" which are interconnected by linking groups, e.g., etheric groups and short ($C_1$–$C_3$) alkylene chains. It has also been indicated that coal contains short aliphatic side chains and heteroatoms.

During the 1960's and 1970's sustained efforts to improve and upscale some of the more promising liquefaction procedures were made. Examination of available publications and reports indicates, however, that in most cases optimization was sought mainly by improvement of the engineering aspects of these processes, with relatively lesser attention paid to the possibility of major modifications based on better understanding and control of the critically important organic-chemical aspects of coal liquefaction. This approach apparently did stem to a large extent from the insufficient knowledge on coal structure at a molecular level, as well as from a widely accepted belief that coal can be transformed into a desirable range of liquid products by application of drastic operating conditions, irrespective of its exact chemical structure and inherent chemical properties. The scientific inadequacy of this approach is best illustrated by the marked lack of novelty and imagination in catalyst development for coal liquefaction during the above indicated period.

Both physical and chemical methods have been extensively used in the investigation of coal structure. Physical studies have included application of spectral methods, e.g., X-ray scattering, ultraviolet and visible spectroscopy, reflectance, C-13 nuclear magnetic resonance (CMR), etc., as well as determination of physical properties, e.g. molar refraction, electrical conductivity, molar diamagnetic susceptibility, molar volume, dielectric constant, sound velocity, thermal stability, etc.

Parallel to the work on the engineering improvement of coal liquefaction processes, a large number of studies concerned with the organic chemistry of coal have been reported in the literature. These studies have significantly contributed to the understanding of the chemical functionality of coal, and have provided information on certain types of organic reactions which could be used to affect the extent of its solubilization. With few exceptions, a more or less similar coal-structural working model was used by the above authors in interpretation of results obtained. The model suggested consists of rather small (2- to 5-ring) naphthenoaromatic or naphthenoaromatic-heterocyclic condensed systems (clusters) interconnected by different types of linking groups. The size of the clusters, i.e., the number of condensed rings per cluster, increases with increase in coal rank. The proportion of aromatic and hydroaromatic rings in the clusters also depends on the rank of the coal. Catalytic dehydrogenation and other methods have been previously used to derive tentative estimates of alicyclic ring contents in coal. These estimates have been generally low, e.g., up to 20%, as compared to recent and more reliable CMR data, which indicate a high proportion (40–50%) of saturated carbons in coals, primarily in naphthenic rings, and to a lesser extent in the form of alkyl and alkylene groups.

It should be noted that the proposed interlinked cluster models for coal have been usually two-dimensional. Unfortunately, consideration of three-dimensional models, and realization of the importance of steric hindrance effects in the approach of reactants or catalysts to the linking units of the coal structure, has been negligible. Close examination of the prior studies indicates that some suggested coal conversion reactions, e.g., reduction, reductive alkylation, catalytic hydrogenation or dehydrogenation, etc., affect mainly the naphthenoaromatic-heterocyclic clusters, and to a lesser extent the interlinking units. Consequently, although such reactions may lead to extensive chemical changes in the coal and attendant partial depolymerization and solubilization, the observed depth of coal breakdown into low molecular weight, monocluster components is not significant, as evidenced by the characteristically high molecular weight of the coal liquids formed. Studies concerned with the possibility of obtaining coal-structural data by selective or at least preferential cleavage of the interlinking units, for instance by reverse Friedel-Crafts reactions catalyzed by Lewis acids, have recently received increased attention.

A major part of the previously reported coal structural studies have been based on separation and identification of products obtained by coal liquefaction. It should be noted in connection with this that under the drastic operating conditions of conventional liquefaction procedures (temperature, 350°–465° C.; high hydrogen pressure; sulfided catalysts) there is not only an initial non-selective breakdown of the coal framework into simpler structural components but also extensive secondary chemical reactions of such primary products, resulting to an important extent in transformation of functional groups and skeletal rearrangements. Therefore, there seems to be limited value to coal structural assignments based on the composition of liquid products obtained under drastic experimental conditions.

Similar limitations in structural assignments and in coal solubilization apply to extractive liquefaction studies at moderate temperatures (275°-300° C.) involving the use of reactive "specific" solvents, in particular phenol and naphthols. The high reactivity of phenols at such temperatures in a variety of catalytic processes e.g., O- and C-alkylation, dienone-arenol rearrangements, Meerwein-Ponndorf reductions, etc., has been previously demonstrated. In effect, such compounds cannot be considered as solvents, in the usual sense, since they interact with coal to form products which are not related in a simple manner to the original coal structure. In other words, it is doubtful that in such cases it is possible to differentiate between products of simple coal degradation and products formed by various interactions of the phenol "solvent" with reactive components of the coal structure. Catalytic studies on coal depolymerization using phenols (at reflux temperature) as solvents are therefore also of limited value in regard to coal structural determination, or coal liquefaction.

Conventional high-temperature (>375° C.) coal liquefaction processes are characterized by low selectivity for light liquid products and preferential production of heavy oils, which require extensive upgrading for use as conventional fuels. Some of the basic problems associated with such processes can be attributed to the relatively limited availability and reliance on data pertaining to coal structure at a molecular level, and to the somewhat unreasonable expectation that the different types of intercluster linkages in the polymeric network of coal can be exhaustively cleaved by a single type of reaction, i.e., non-selective hydrogenolysis. Reviews covering the large volume of high-temperature (>375° C.) coal liquefaction studies have been recently provided (Gorin, E., in "Chemistry of Coal Utilization", 2nd Supplementary Vol., M. A. Elliot, ed., J. Wiley & Sons, New York, 1981, Chapter 27, pp. 1845-1918, and references therein).

In-depth structural analysis of products obtained by single-step metal halide-catalyzed hydrotreatment at 315°-375° C. of several coals, e.g., a Fruitland, N.M., coal, and a Utah Hiawatha coal, shows that even the simplest product components have a bi-cluster, i.e., incompletely depolymerized, structure. This demonstrates the limit in the depth of coal depolymerization which can be achieved by a single type of reaction, e.g., hydrotreatment.

In view of the numerous efforts to obtain a desirable coal-derived liquid from coal by means of a high temperature, single stage reaction process, and in view of the less than desirable results obtained thereby, it would be a significant advancement in the art to provide a novel, low-temperature process for the depolymerization and liquefaction of coal particularly through several sequential steps which will selectively cleave different types of bonds within the coal in each processing step. Such a novel process is disclosed and claimed herein.

BRIEF SUMMARY AND OBJECTS OF THE INVENTION

This invention relates to the low-temperature depolymerization and liquefaction of coal whereby sequential process steps are conducted to selectively cleave different types of bonds within the coal structure. The first process step involves the partial depolymerization of the coal by the preferential hydrogenolytic cleavage of methylene, benzyletheric and some activated aryletheric linkages in the coal framework. The second process step is designed to complete the depolymerization of the partially depolymerized product of the first step by base-catalyzed hydrolysis of diaryletheric, dibenzofuranic, and other bridging groups. The resulting depolymerized product is then subjected to hydroprocessing in the third process step resulting in exhaustive heteroatom removal and attendant partial hydrogenation and C—C hydrogenolysis.

It is therefore, a primary object of this invention to provide improvements in the depolymerization and liquefaction of coal.

It is another object of this invention to provide a low-temperature process for the depolymerization and liquefaction of coal, which is economically and environmentally advantageous in comparison with high temperature coal liquefaction processes.

Another object of this invention is to provide a stepwise process for the depolymerization and liquefaction of coal wherein the process steps occur in sequence so as to selectively cleave different types of bonds within the coal structure in each step thereby avoiding undesirable side reactions, e.g., excessive gasification and coking, which typically accompany high-temperature, single-step coal liquefaction processes.

Another object of this invention is to develop an efficient low-temperature coal depolymerization and liquefaction process which produces primarily light hydrocarbon oils, instead of the heavy oils usually obtained by high-temperature (>375° C.) coal liquefaction processes.

These and other objects and features of the present invention will become more fully apparent from the following description and attendant claims taken in conjunction with the accompanying drawings.

DESCRIPTION OF THE PREFERRED EMBODIMENTS

The invention is best understood by reference to the drawings in conjunction with the accompanying description of the invention.

Numerous studies have been reported on the development of low-temperature coal solubilization procedures. This previous work was thoroughly reviewed in 1981 (Wender, I., Heredy, L. A., Neuworth, M. B. and Dryden, I. G. C., "Chemistry of Coal Utilization", 2nd Supplementary Vol., M. A. Elliot, ed., J. Wiley & Sons, New York, 1981, chapter 8, pp. 425-455, and references therein.) The chemical-catalytic procedures include reduction with lithiumethylenediamine, reductive alkylation, transaralkylation with a phenol-$BF_3$ system, transaralkylation with phenol using p-toluenesulfonic or benzenesulfonic acid as catalysts, Friedel-Crafts alkylation or acylation, base-catalyzed hydrolysis, base-promoted hydrogen transfer, hydrotreatment in the presence of metal halides, etc. The above procedures lead to coal solubilization by means of major chemical modification of the coal structure and attendant partial depolymerization. Analytical data on the products obtained indicate, however, that the above procedures do not cause complete coal depolymerization into low molecular weight, monocluster products. Recent coal-structural studies in this Department have indicated the presence of a variety of intercluster linking groups in coal and coal-derived liquids (CDL), including alkylene (e.g., methylene), diaryl (i.e. Ar-Ar), benzyletheric, aryletheric, dibenzofuranic, and other groups. Some of these linkages, e.g., methylene, benzyletheric, and some activated aryletheric groups, are easily susceptible to hydrogenolytic cleavage, but others, e.g., sterically hindered diaryletheric, dibenzofuranic and diaryl (Ar-Ar) groups could show considerable resistance to hydrogenolysis as evidenced by their persistence in the molecular structure of CDL components. It was demonstrated recently that there is a limit in the depth of coal depolymerization which can be achieved by a single type of reaction, e.g., hydrotreatment.

Figure 1:
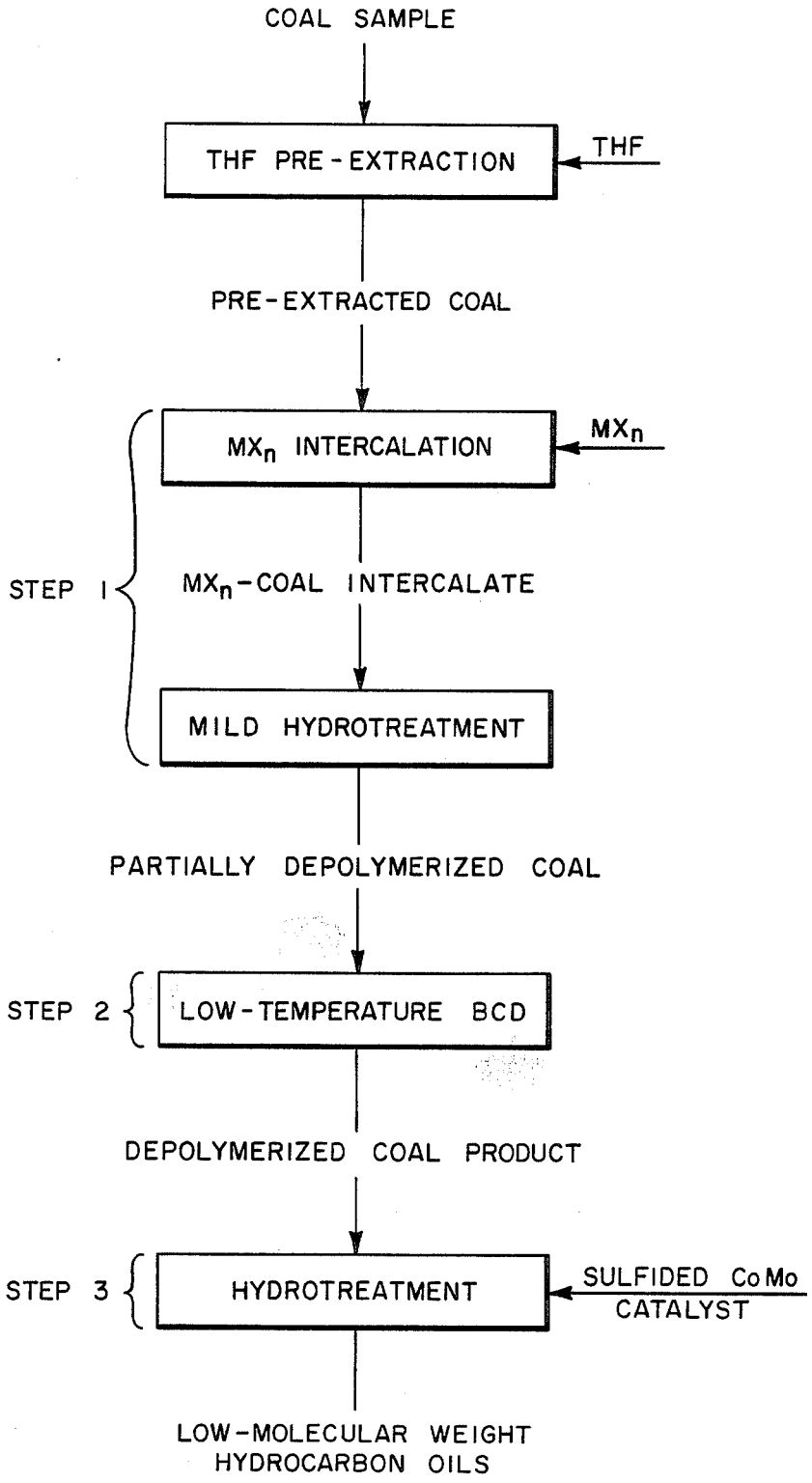
FIG. 1 is a schematic presentation of the low-temperature coal depolymerization process of this invention, in which HT = mild hydrotreatment, and BCD = base catalyzed depolymerization.

On the basis of the above mentioned structural data, a new approach to low-temperature (≦275° C.) coal depolymerization was developed. It involves the application of two or more consecutive reaction steps in which different types of intercluster linkages are subjected to selective or preferential cleavage, leading ultimately to a low-molecular weight product. The present invention provides a first example of the use of such a multi-step procedure for conversion of a coal sample into a light hydrocarbon oil. The procedure, summarized in FIG. 1, consists of the following sequential steps: (1) intercalation viz., deep-seated impregnation of the coal sample with catalytic amounts of a metal halide, in particular $ZnCl_2$ or $FeCl_3$, followed by mild hydrotreatment (HT) of the coal-metal halide intercalate; (2) base-catalyzed depolymerization (BCD) of the product from step 1; and (3) hydroprocessing of the depolymerized product from the two preceding steps with a sulfided CoMo catalyst. Step 1 results in partial depolymerization of the coal by preferential hydrogenolytic cleavage of methylene, benzyletheric and some activated aryletheric linkages in the coal framework, while step 2 is designed to complete the depolymerization of the product from step 1 by base-catalyzed hydrolysis (or alcoholysis) of diaryletheric, dibenzofuranic, and other bridging groups. In step 3 the final depolymerized product is subjected to hydroprocessing resulting in exhaustive heteroatom removal and attendant partial aromatic ring hydrogenation and C—C hydrogenolysis. Included in step 3 are also reactions resulting in the conversion and ultimate removal of any residual dibenzofuranic linking groups, which survive to some extent the BCD step.

The overall efficiency of the above depolymerization procedure was determined as a function of experimental variables (temperature, pressure, catalyst concentration, etc.), and suitable conditions for conversion of a coal sample into a light hydrocarbon oil were determined.

DESCRIPTION OF THE PROCESS

The novel process of this invention is illustrated by the following nonlimiting procedure which uses one type of coal to illustrate the process steps.

Materials

A coal sample from Wyodak, Wyo., referred to below as W(W) coal, was provided by Standard Oil of Indiana. The ultimate analysis of the sample (MAF basis) in wt %, was C, 76.03; H, 5.35; N, 1.37; Cl, 0.02; S, 0.60; O (diff.), 16.63. H/C atomicratio=0.84; ash content (dry basis), 8.9%. The sample, stored and refrigerated under nitrogen, was crushed and sieved through a 200-mesh standard sieve prior to use.

Catalysts

The catalyst systems used in the mild HT step and in the BCD step (FIG. 1) consisted of intercalated, catalytic amounts (1–20%) of a metal halide, e.g., $ZnCl_2$ or $FeCl_3$ and of a 3–10% alcoholic alkali hydroxide solution, respectively. The catalyst used in the hydroprocessing step 3 consisted of a sulfided 6% Co8% Mo/gamma-$Al_2O_3$, prepared by incipient wetness impregnation of Ketjen gamma-$Al_2O_3$, with an ammonical solution of ammonium paramolybdate, followed by impregnation with an aqueous $Co(NO_3)_2$ solution.

DESCRIPTION OF THE APPARATUS AND EXPERIMENTAL PROCEDURE

Mild HT Step

The powdered W(W) coal sample was pre-extracted with THF in a Soxhlet for 48 hr., yielding 4–5% of solubles, including resins. The pre-extracted coal was intercalated with 1% to 20% by wt of a metal halide, e.g. $FeCl_3$ or $ZnCl_2$.

The intercalation of the pre-extracted coal was performed with an acetone solution of the metal halide, using an ultrasonic bath for thorough mixing. After 1 hour, the excess acetone was distilled off, and the intercalated coal was dried in a vacuum oven (110° C., 2 torr) until constant weight, and then stored in sealed bottles under nitrogen. The use of acetone as a solvent is greatly advantageous in comparison with previously used solvents, e.g., water or methanol, since acetone apparently forms a planar complex with the metal halide and thereby the latter is capable of deep penetration into the coal particles, as indicated by electron microprobe analysis.

The dried metal halide-coal intercalate was then hydrotreated at 225°–275° C., 1000–1500 psig, for 1–3 hr using a specially designed autoclave reactor. The latter is made of 316 stainless steel tubing, union tees and caps. The metal halide-coal sample is placed in a container and introduced into the reactor. A thermocouple is lowered to secure direct contact with the coal. Finally, the reactor is closed, purged from air, pressurized with hydrogen, and quickly heated to the desired temperature in a sand bath. The resulting product is extracted with acetone to recover the metal halide, and then with THF to remove a small amount (<10%) of THF-soluble hydrotreatment products.

BCD Step

The mildly hydrotreated solid coal product from the HT step (FIG. 1) together with the above mentioned small amount (<10%) of solubilized material, was subjected to reaction with a 3–10% solution of NaOH or KOH in methanol, ethanol, or isopropanol. The BCD runs were performed in a 40 ml shaker autoclave or in a 300 ml stirred autoclave, using a ratio of 10 ml of 10% alcoholic NaOH or KOH per gram of hydrotreated W(W) coal. The mixture was charged to the autoclave, the latter was purged and pressurized (1000 psig) with nitrogen, and heated at the selected reaction temperature (200°-275° C.) for 1 hour. The resulting mixture was acidified (pH, ~2) and the organic product was separated from the aqueous layer, washed with water, dried, and extracted with THF in a Soxhlet, leaving a minor residue, consisting mainly of the original coal ash. In some runs the BCD product was subjected to solvent fractionation into cyclohexane-solubles (oils), benzene-solubles (asphaltenes), and residual THF-solubles (asphaltols).

Hydroprocessing (HPR) Step

The total depolymerized product from HT-BCD was dissolved in o-xylene and hydrotreated in a 300 ml stirred autoclave, using the above mentioned 6Co8-Mo/gamma-$Al_2O_3$ catalyst. In typical runs 5.0 g of the feed was dissolved in 50 ml of o-xylene, and 1.0 g of catalyst and 0.06% of $CS_2$ was added. The mixture was hydrotreated at 350° C. and a $H_2$ pressure of 2700 psig for 4 to 8 hr. The product was examined by elemental analysis, simulated distillation, IR and $C^{13}$ NMR.

REVIEW OF THE EFFECT OF PROCESSING CONDITIONS UPON PRODUCT COMPOSITION

Mild Hydrotreatment (HT)

Figure 2:
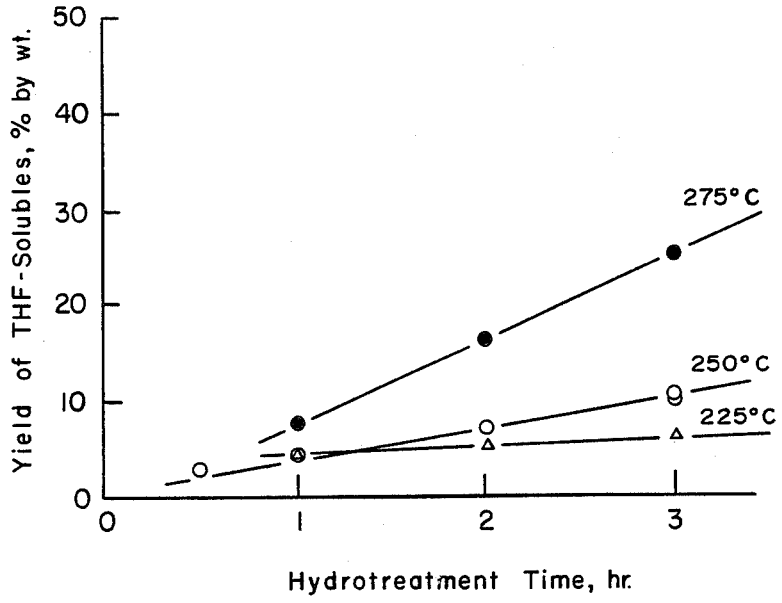
FIG. 2 is a graph representing the yield of THF-solubles from hydrotreatment of a Wyodak (Wyoming) coal sample using a 20% zinc chloride-coal intercalate as feed.

Electron microprobe analysis of W(W) coal samples intercalated with a metal halide from an acetone solution indicated considerable dispersion of the salt inside the coal particles, while conventional impregnation with the same metal halides from an aqueous solution showed deposition of the salts at the surface of the coal particles. Further, scanning electron microscopy of partially depolymerized W(W) coal samples, obtained by HT of the metal halide-coal intercalates and subsequent back extraction of the metal halide (FIG. 1), showed that such treatment produces high macroporosity in the coal. Conditions for mild HT of the metal halide-coal intercalates were sought under which there is only partial breakdown of the coal framework by selective cleavage of alkylene and benzyletheric linkages, with minimal (<10%) attendant solubilization. FIG. 2 shows the yield of THF-soluble products from HT of a W(W) coal-20% $ZnCl_2$ intercalate as a function of temperature and time. As seen, hydrotreatment at 225°-250° C. for 1-3 hr, or at 275° C. for 1 hr, yields ≦10% of THF-solubles, indicating a suitable range of conditions for the HT step of this particular coal. It was also found that a temperature of 275° C. is suitable if the $ZnCl_2$ concentration in the intercalate is lowered to 5-10%. $FeCl_3$ was found to be a more selective and desirable catalyst which can be efficiently applied in concentrations of 2-15% by wt., using various coals, e.g., Utah Braz and Hiawatha coals, Illinois no. 6 coal, and Fruitland, N. M. coal, as feeds.

Base-Catalyzed Depolymerization (BCD)

Figure 3:
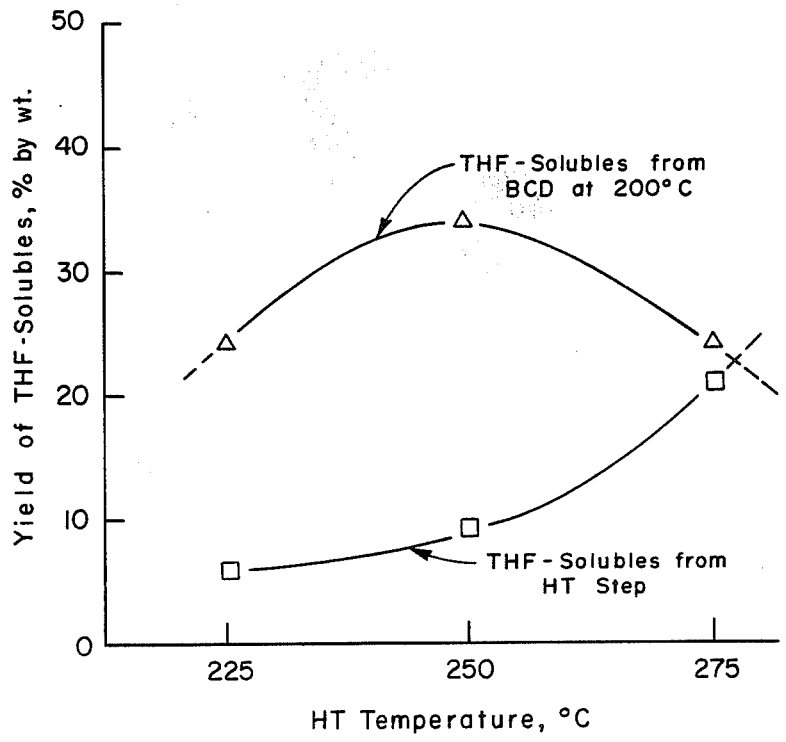
FIG. 3 is a graph illustrating the effect of HT temperature upon THF-solubles yield in the BCD step.
Figure 4:
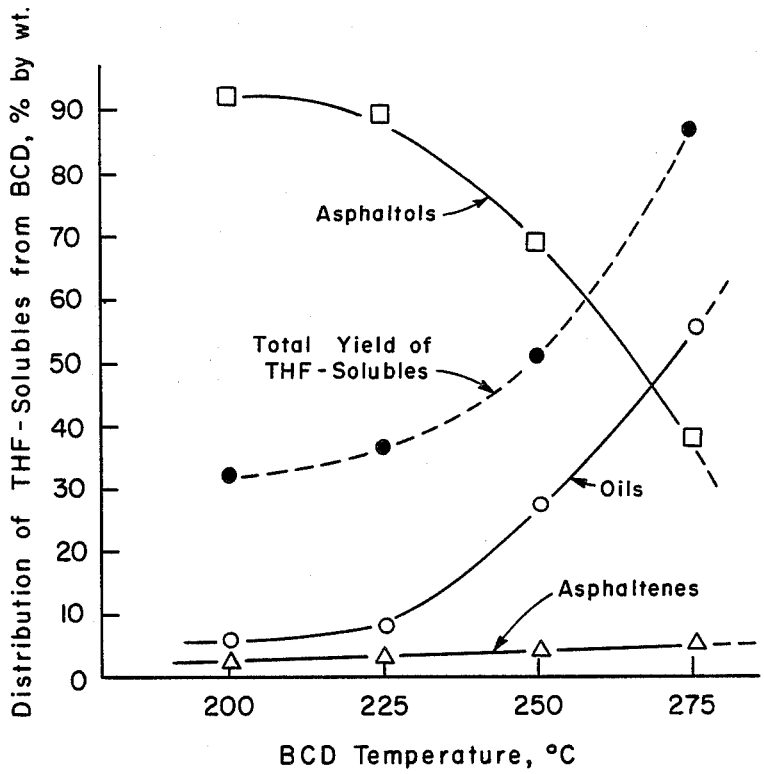
FIG. 4 is a graph illustrating the effect of BCD temperature upon product distribution into oils, asphaltenes, and asphaltols.
Figure 5:
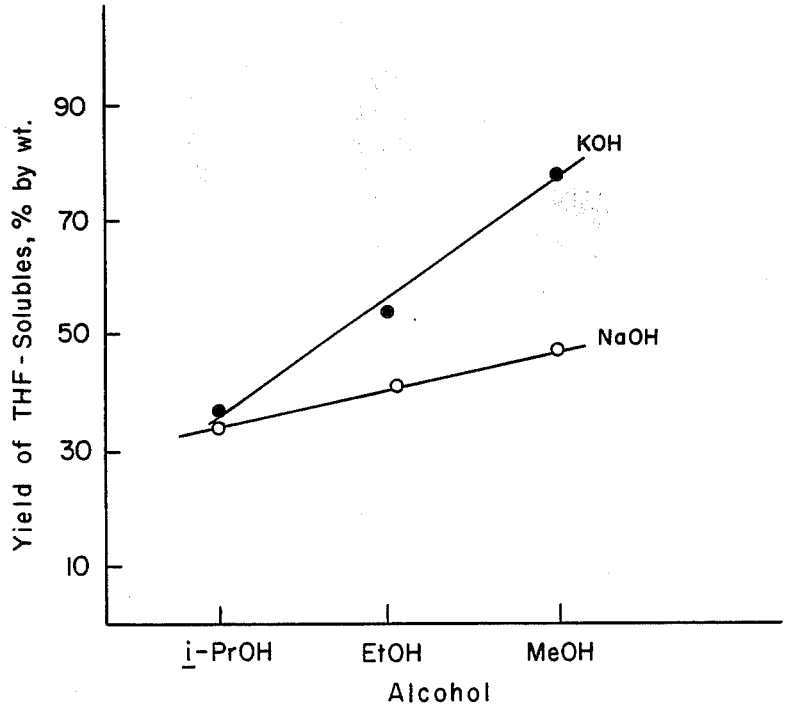
FIG. 5 is a graph illustrating the effect of base catalyst and type of alcohol upon BCD efficiency.

FIG. 3 shows the effect of temperature used in the HT step upon the yield of THF-soluble products in the subsequent BCD step (at 200° C.). As seen, highest BCD yield with the W(W) coal as feed is obtained with the HT product treated at 250° C. This corresponds to a temperature at which about 10% of THF-solubles are formed in the HT step. Increase in HT temperature to 275° C. causes a decrease in the yield of THF-solubles from the BCD step. FIG. 4 shows the effect of BCD temperature upon the yield and composition of THF soluble products, using as feed the HT product obtained at 250° C. from the W(W) coal-20% $ZnCl_2$ intercalate and a 10% ethanolic solution of NaOH as depolymerization agent. As seen, the total yield of THF solubles increases sharply with temperature (from 30% at 200° C. to 84% at 275° C.). Further, the proportion of asphaltols sharply decreases while that of oils correspondingly increases with increase in BCD temperature. FIG. 5 summarizes the effects of the type of alkali hydroxide and the type of alcoholic solvent upon the efficiency of the BCD step as reflected in the yield of THF-solubles. As seen, the yield is considerably higher with KOH as compared with NaOH as catalyst. The alcohol has also a profound effect, the depolymerization efficiency being in the order MeOH>EtOH>i-PrOH. The combination of KOH and methanol is a particularly powerful catalyst-solvent system, and it was found in additional experiments that at a BCD temperature of 275° C. it causes complete depolymerization of the HT product from W(W) coal into THF-soluble products, including ≧60% of oil components.

Hydroprocessing (HPR) of HT-BCD Products

The depolymerized products from the above HT-BCD treatment of W(W) coal were subjected in a separate study to detailed structural analysis by a combination of quantitative $C^{13}$NMR, PMR, and FTIR, supplemented by molecular weight and elemental composition determinations. The data obtained indicate that such products contain predominantly simplified, monocluster compounds, in contrast to conventional coal-derived products which consist mainly of bi-, tri- and polycluster components. The response of the depolymerized W(W) coal products to hydroprocessing with sulfided catalysts was determined, and results obtained are illustrated by the following example: A sample of the W(W) coal product obtained by the HT-BCD procedure, using a 10% methanolic solution of KOH in the BCD step, was found to contain (MAF basis): C, 77.59; H, 9.35; O, 11.85; and N, 1.21 wt %. Simulated distillation of this depolymerized material showed a cumulative yield of low-boiling fractions (gasoline, kerosene and light gas oil (b.p. up to 305° C./760 torr) of only 8.5% by wt. Hydroprocessing of the total depolymerized product with a sulfided 6Co8Mo catalyst (for conditions, see description above) yielded a light hydrocarbon oil (C, 87.57; H, 11.60; O, 0.59; and N, 0.24 wt %), which contained 57.2 wt % of low-boiling fractions (gasoline, kerosene and light gas oil; b.p. up to 305° C./760 torr) (see Table).

BOILING POINT DISTRIBUTION OF PRODUCTS FROM HT - BCD - HPR OF WYODAK COAL[a]

| Fraction (b.p. range, °C.) | % by wt |
|---|---|
| Gasoline ($C_5$-200°) | 19.8 |
| Kerosene (200-275°) | 16.5 |
| Light Gas Oil (275-325°) | 20.9 |
| Heavy Gas Oil (325-400°) | 16.3 |
| Vacuum Gas Oil (400-538°) | 20.1 |
| Total Distillable (<538°) | 93.6 |
| Atmospheric residue (<325°) | 42.8 |
| Vacuum residue (>538°) | 6.4 |

[a]HPR conditions; 350° C.; 2700 psig; 4 hr

Hydrotreatment of the starting, non-depolymerized W(W) coal under identical conditions yielded only 12.5% of such low-boiling products. This indicates that depolymerized W(W) coal products are easily susceptible to HDO, HDN, and attendant ring hydrogenation and C—C hydrogenolysis reactions, to yield light hydrocarbon oils.

EXAMPLES

EXAMPLE 1

20.0 g of a Wyodak, Wyo. coal sample (ultimate analysis, MAF basis, wt %: C, 76.03; H, 5.35; N, 1.37; Cl, 0.02, S, 0.60; O, 16.63) was crushed in the absence of oxygen in a glove box and then sieved through a 200-mesh standard sieve. The resulting powdered coal was first extracted with redistilled tetrahydrofuran in a Soxhlet for 24 hr, yielding 4.6% by wt of THF-solubles, mostly resins. The extracted coal was then divided in about 5 gram portions, and each portion was intercalated with 20% by wt of $ZnCl_2$ by thoroughly mixing the coal with an acetone solution of $ZnCl_2$ in an ultrasonic bath for 1 hr. The excess acetone was distilled off and the $ZnCl_2$-intercalated coal was dried in a vacuum oven at 110°/2 torr and stored in sealed bottles under nitrogen. Eight grams of intercalated coal were placed in a glass container and hydrotreated in a specially designed small autoclave at 250° C., under a hydrogen pressure of 1500 psig, for 3 hr. The resulting mildly hydrotreated coal was transferred to a Soxhlet and back-extracted with acetone to recover the $ZnCl_2$ catalyst. For this purpose, the acetone extract was freed from the solvent by vacuum distillation and the solid residue was treated with excess water to dissolve the back-extracted $ZnCl_2$, leaving as a residue a small amount (8.3%) of water-insoluble organic product resulting from the mild hydrotreatment. This product was returned to the mildly hydrotreated and back-extracted coal in order to avoid any loss of organic material.

A 6.0 g portion of the mildly hydrotreated coal produced by the above procedure, was then reacted with 60 ml of a 10% methanolic solution of KOH in a 300 ml magne-dash autoclave at 275° C., under a nitrogen pressure of 1,000 psig, for 1 hr. The product mixture was acidified to a pH of about 2, and the organic material was separated from the aqueous layer, washed with water, dried, and extracted with THF in a Soxhlet, leaving 7.9% by wt of a solid residue, consisting mainly of the ash of the starting coal. The total yield of THF-soluble product obtained by the above sequential coal processing was 91.2% by wt, as calculated on the MAF coal feed. The total loss, including gas formation, was about 9% by wt.

5.0 g of the total THF-soluble product from the above procedure was dissolved in 50 ml of o-xylene, and 1.0 g of a presulfided 6Co8Mo on gamma-$Al_2O_3$ catalyst and 0.06% of $CS_2$ was added. The mixture was hydroprocessed in an autoclave at 350° C., under a hydrogen pressure of 2700 psig, for 4 hr, to produce a hydrocarbon oil, containing in wt %: C, 87.57; H, 11.60; O, 0.59; S, 0.05; N, 0.24. The yield of the hydrocarbon oil product in the hydroprocessing step was 82.5% by wt, which was about 94% of the theoretically possible, due to the heteroatom removal reactions. The hydrocarbon oil contained 57.2% by wt of gasoline, kerosene and light gas oil fractions boiling up to 325° C./760 torr.

EXAMPLE 2

A 5.0 g portion of the THF-extracted Wyodak, Wyoming coal was subjected to the same processing as in Example 1, except that a 10% ethanolic solution of NaOH was used as catalyst-solvent agent in the base-catalyzed depolymerization step. The yield of the hydrocarbon oil product in the final hydroprocessing step was 83.1% and it contained 47.9% by wt of gasoline, kerosene and light gas oil fractions, boiling up to 325° C./760 torr.

EXAMPLE 3

5.0 g of a Utah Braz-5 coal sample (ultimate analysis, MAF basis, wt %: C, 81.10; H, 5.97; N, 1.09; Cl, 0.03; S, 0.49; O, 11.32) was prepared for processing as in Example 1 and extracted with THF to yield 9.0% of THF-soluble, resinous material. The extracted coal was processed using the same sequential processing steps used in Example 1, except that 10% $FeCL_3$ was used as metal halide catalyst in the first (HT) processing step and the HT temperature applied was 275° C. The yield of THF-soluble product from the stepwise HT-BCD processing was 87.3% as calculated on the MAF coal feed, and the yield of the hydrocarbon oil product obtained in the final hydroprocessing step was 84.8% by wt. The final hydrocarbon oil product contained 59.6% of gasoline, kerosene and light gas oil fractions distilling up to 325° C./760 torr. The total hydrocarbon oil contained 0.16% by wt of oxygen and 0.09% by wt of nitrogen.

EXAMPLE 4

10.0 g of a THF-pre-extracted Utah Braz-5 coal sample was subjected to the same sequential processing used in Example 1, except that the following conditions were used in the mild hydrotreatment step: catalyst, 5% $FeCL_3$; temperature, 250° C.; hydrogen pressure, 1500 psig; and reaction time, 2 hr. The temperature in the base-catalyzed depolymerization step was 290° C. The yield of the hydrocarbon oil product obtained in the final hydroprocessing step was 81.2%, and it contained 53.3% of gasoline, kerosene and light gas oil fractions distilling up to 325° C./760 torr.

EXAMPLE 5

10.0 g of an Illinois no. 6, Burning Star coal sample (ultimate analysis, MAF basis, wt %: C, 78.89; H, 5.35; N, 1.22; Cl, 0.14; S, 4.37%; O, 10.04%) was prepared, pre-extracted with THF, and then subjected to the same three-step processing used in Example 1. The yield of the hydrocarbon oil product obtained in the final hydroprocessing step was 81.6% by wt. The total hydrocarbon oil product contained, wt %: O, 0.23; S, 0.08; N, 0.17. Distillation of the hydrocarbon oil product yielded 49.7% of gasoline, kerosene and light gas oil fractions, boiling up to 325° C./760 torr.

EXAMPLE 6

10.0 g of a Fruitland, N. M. coal sample (ultimate analysis, MAF basis, wt %: C, 78.69; H, 6.0; N, 1.62; Cl, 0.07; S, 0.96; O, 12.66) was prepared, pre-extracted with THF, and then subjected to the same three-step processing used in Example 1, except that 20% $FeCL_3$ was used as metal halide catalyst in the mild hydrotreatment (HT) step, and the hydrotreatment temperature was increased to 275° C. The yield of the hydrocarbon oil product obtained in the final hydroprocessing step was 79.4% by wt. Distillation of the hydrocarbon oil product yielded 52.1% of fractions boiling up to 325° C./760 torr.

EXAMPLE 7

10.0 g of the same Wyodak, Wyo. coal sample used in Example 1, was prepared, pre-extracted with THF, and then subjected to the same three-step processing of Example 1, except that 10% $FeCl_3$ was used as metal halide catalyst in the mild hydrotreatment step, and the hydrotreatment temperature was increased to 275° C. The yield of the hydrocarbon oil product obtained in the final hydroprocessing step was 78.7% by wt.

EXAMPLE 8

10.0 g of the same Wyodak, Wyo. coal sample used in Example 1, was prepared, pre-extracted with THF, and then subjected to the same three-step processing of Example 1, except for the following changes: (a) 5% $FeCl_3$ was used as intercalated metal halide catalyst in the mild hydrotreatment step; (b) the mild hydrotreatment temperature was increased to 275° C.; and (c) the temperature in the base-catalyzed depolymerization step was increased to 290° C. The yield of the hydrocarbon oil product obtained in the final hydroprocessing step with a sulfided CoMo catalyst was 83.0%. Distillation of the hydrocarbon oil yielded 51.7% of gasoline, kerosene and light gas oil fractions, boiling up to 325° C./760 torr.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A process for the low temperature depolymerization and liquefaction of fine particles of coal comprising the combined, sequential steps of:

intercalating the fine particles of coal with a catalytic amount of a metal chloride catalyst;

a first mild hydrotreating of the intercalated coal to produce a partially depolymerized coal as a first intermediate product mix, said product mix comprising depolymerizated coal particles containing catalyst and an organic liquid;

separating substantially said coal particles from said organic liquid;

removing substantially said catalyst from said coal particles;

recombining said substantially catalyst depleted coal particles and organic liquid;

reacting said first intermediate product with a base-catalyzed depolymerization agent consisting essentially of an alcoholic solution of an alkali metal hydroxide to produce depolymerized coal as a second intermediate product; and hydroprocessing the second intermediate product with a sulfided cobalt molybdenum catalyst to produce a hydrocarbon oil as a final product.

2. The process defined in claim 1 wherein the said fine coal particles have a mesh size within the range on the order of about 100 mesh to 200 mesh.

3. The process defined in claim 1 wherein the intercalating step comprises dissolving the catalyst in a suitable organic solvent.

4. The process defined in claim 3 wherein the dissolving step comprises selecting the solvent from the group consisting of acetone, methyl ethyl ketone, diethyl ketone, and other low-boiling ketones.

5. The process defined in claim 1 wherein the intercalating step comprises selecting the metal chloride catalyst from the group comprising iron chloride and zinc chloride.

6. The process defined in claim 1 wherein the intercalating step comprises selecting and using a catalytic amount of metal chloride catalyst in an amount of between 1% and 20% by weight of metal chloride catalyst to coal.

7. The process defined in claim 1 wherein the hydrotreating step comprises operating the process under mild conditions at a temperature within the range on the order of about 225° C. to 290° C. and a hydrogen pressure within the range on the order of about 1000 psig to 2000 psig.

8. The process defined in claim 1 wherein the reacting step with a base-catalyzed depolymerization agent is conducted at a temperature within the range on the order of about 225° C. to 290° C. and under an inert gas at a pressure within the range on the order of about 10 psig to 1000 psig to exclude the presence of oxygen.

9. The process defined in claim 8 wherein the inert gas is nitrogen.

10. The process defined in claim 1 wherein the reacting step comprises selecting the alkali metal hydroxide from the group consisting of potassium hydroxide and sodium hydroxide.

11. The process defined in claim 1 wherein the reacting step comprises selecting the alcohol for the alcoholic solution from the group consisting of methanol, ethanol and isopropanol.

12. The process defined in claim 1 wherein the reacting step comprises preparing the alcoholic solution of alkali metal hydroxide with about 3–10% by weight alkali metal hydroxide in alcohol and using a ratio of about 10 cc of alcoholic solution of alkali metal hydroxide per gram of coal.

13. The process defined in claim 1 wherein the hydroprocessing step is conducted at a temperature within the range on the order of about 350° C. to 370° C. and under hydrogen pressure within the range on the order of about 2000 psig to 3000 psig.

14. The process defined in claim 1 wherein the hydroprocessing step comprises using a sulfided cobalt molybdenum catalyst prepared as a presulfided cobalt molybdenum on a gamma alumina support and containing 3–6% by weight of cobalt and 8% molybdenum.

15. The process defined in claim 1 wherein the hydroprocessing step comprises protecting the sulfided cobalt molybdenum catalyst by adding hydrogen sulfide or carbon disulfide to the hydroprocessing step.

16. A process for the depolymerizing and liquefaction of coal to produce a high quality hydrocarbon oil comprising the combined, sequential steps of:

cleaving methylene, benzyletheric and a small portion of the aryletheric linkages in the coal framework by mild hydrotreatment in the presence of a catalyst capable of cleaving said methylene, benzyletheric and aryletheric linkages to obtain a partially depolymerized coal as a first intermediate product;

removing substantially the catalyst present in said first intermediate product;

further depolymerization of the first catalyst depleted intermediate product by hydrolysis or alcoholysis of the diaryletheric bridging groups, and at least a portion of the dibenzofuranic and other bridging groups to obtain a more fully depolymerized coal as a second intermediate product; and hydroprocessing the second intermediate product under conditions suitable to achieve substantial heteroatom removal and for partial ring hydrogenation and attendant C—C hydrogenolysis thereby producing a high quality hydrocarbon oil as final product from the coal.

17. The process defined in claim !6 wherein the cleaving step comprises:

producing a finely dived coal, intercalating the coal with a metal chloride catalyst in an amount of between 1% and 20% by weight metal chloride catalyst to coal and hydrotreating the intercalated coal under mild conditions at a temperature within the range on the order of about 225° C. to 290° C. and a hydrogen pressure within the range on the order of about 1000 psig to 2000 psig.

18. The process defined in claim 17 wherein the intercalating step comprises selecting the metal chloride catalyst from the group consisting of iron chloride and zinc chloride, and dissolving the metal chloride catalyst in a suitable organic solvent selected from the group consisting of acetone, methyl ethyl ketone, diethyl ketone, or other low-boiling ketone.

19. The process defined in claim 16 wherein the further depolymerization step comprises conducting the hydrolysis or alcoholysis step as a base-catalyzed depolymerization with an alkali metal hydroxide selected from the group consisting of potassium hydroxide and sodium hydroxide dissolved in an alcohol selected from the group consisting of methanol, ethanol and isopropanol on the basis of about 3–10% by weight alkali metal hydroxide to alcohol and about 10 cc alcoholic solution per gram of the first intermediate product and at a temperature within the range on the order of about 225° C. and under a nonreactive gas atmosphere to exclude the presence of oxygen.

20. The process defined in claim 16 wherein the hydroprocessing step comprises reacting the second intermediate product with hydrogen in the presence of a sulfided cobalt molybdenum catalyst at a temperature within the range on the order of about 350° C. to 370° C. and under hydrogen pressure within the range on the order of about 2000 psig to 3000 psig, the sulfided cobalt molybdenum catalyst being prepared in the form of a presulfided cobalt molybdenum on a gamma alumina support with hydrogen sulfide being used during the hydroprocessing step to protect the sulfided cobalt molybdenum catalyst.

* * * * *